United States Patent [19]

Harris et al.

[11] Patent Number: 5,062,219

[45] Date of Patent: Nov. 5, 1991

[54] AIR FLOW APPARATUS FOR CLOTHES DRYER

[75] Inventors: Robert D. Harris, Oshkosh; Brett J. Putnam, Ripon, both of Wis.

[73] Assignee: Speed Queen Company, Ripon, Wis.

[21] Appl. No.: 654,442

[22] Filed: Feb. 12, 1991

[51] Int. Cl.[5] ..... F26B 11/02

[52] U.S. Cl. ..... 34/133; 34/242

[58] Field of Search ..... 34/133, 134, 131, 132, 34/242

[56] References Cited

U.S. PATENT DOCUMENTS

| | | | |
|---|---|---|---|
| 2,764,820 | 10/1956 | Kauffman | 34/133 |
| 4,899,462 | 2/1990 | Putnam et al. | 34/133 |
| 4,961,274 | 10/1990 | Coffman | 34/133 |

*Primary Examiner*—Henry A. Bennet

*Attorney, Agent, or Firm*—William R. Clark; Richard M. Sharkansky

[57] ABSTRACT

Air flow apparatus for a clothes dryer wherein a flexible wrap having sealing runners is supported in sliding engagement on the rotating drum to cover that portion of the perforated annulus that is not istantaneously aligned with the suction duct. The end of the wrap opposite the direction of rotation of the drum is resiliently held such as by springs such that the tension on the wrap and the pressure on the drum is self-adjusting and maintained substantially constant. Therefore, the sealing runners are maintained in substantially uniform and continuous contact against the drum to limit the air flow path from the drum so that substantially all of the exiting air passes into the suction duct.

24 Claims, 6 Drawing Sheets

AIR FLOW APPARATUS FOR CLOTHES DRYER

BACKGROUND OF THE INVENTION

The field of the invention generally relates to clothes dryers and more particularly relates to apparatus for controlling the flow of air through clothes dryers.

In a prior art commercial clothes dryer, a burner box communicates with an inlet on the back wall of a horizontally oriented clothes drum that has a perforated front annulus. A stationary suction duct has an arcuate top mouth that conforms with and is positioned in close spaced relationship with an underside portion of the perforated annulus. Thus, even though the drum is rotated to tumble the clothes, the suction duct is always aligned with a portion of the perforated annulus such that air is continuously being drawn from the burner box through the clothes drum and into the suction duct via the perforations that are instantaneously aligned with the suction duct. The air in the suction duct passes through a filter which collects the lint, and then back a conduit to an exhaust fan which provides the induced draft for the heretofore described air flow. The air is then exhausted or, alternately, a small percentage of the air may be recirculated back into the clothes drum.

Even though the intended air flow path in the above described arrangement is from the rotating clothes drum into the suction duct through the perforations that are instantaneously aligned with the mouth of the suction duct, some lint laden air also exits perforations that are not instantaneously aligned with the suction duct. More specifically, there is a small gap between the suction duct and the outer surface of the drum, and air is drawn into the suction duct through this gap thereby creating a slightly negative pressure inside the outer cabinet of the dryer. This slightly negative pressure along with the effects of centrifugal force within the drum cause some lint laden air to exit drum perforations that are instantaneously at the top and sides (i.e. perforations that are not instantaneously aligned with the suction duct at the bottom).

The unintended air flow path through the top and side perforations causes several problems. First, this air carries lint which drops down and collects in the interior of the cabinet thereby requiring relatively frequent cleaning. Thus, the periodic maintenance costs of the dryer are relatively high. Second, this air is hot and heats the interior of the cabinet thereby decreasing the overall efficiency of the dryer. Third, the temperature in the drum becomes difficult to regulate because the burner controller senses the exhaust air temperature which does not accurately correspond to the drum temperature if there are unknown and variable heat losses from the drum to the interior of the cabinet. Thus, the drum may operate too hot if there are greater than normal heat losses to the cabinet interior, or too cool if such heat losses are less than normal.

A rigid cylindrical baffle has been connected to the outer cabinet and used to surround the perforated annulus, but such arrangement has not provided an effective seal for eliminating the above described unintended air flow path. Further, the baffle is difficult to install as part of a retrofit kit, and it is also difficult to remove and reinstall it later for maintenance and repair.

SUMMARY OF THE INVENTION

It is an object of the invention to provide a clothes dryer that requires a minimum of maintenance and, in particular, periodic lint cleaning.

It is also an object to provide a commercial clothes dryer having a stationary arcuate suction duct wherein substantially all of the lint laden air exiting the clothes drum enters the suction duct.

It is a further object to limit or substantially reduce the accumulation of lint within the cabinet of a commercial clothes dryer having an arcuate suction duct that draws air from the clothes drum.

It is also an object to channel substantially all the hot air from the clothes drum into the suction duct so that the overall efficiency is not reduced by heat losses within the cabinet.

It is a further object to provide an air flow path through a dryer such that the exhaust temperature accurately reflects the temperature within the clothes drum.

It is a further object to provide a wrap that is relatively easy to install or retrofit, and provides a relatively low friction seal for that portion of the perforated annulus that is not instantaneously aligned with the arcuate suction duct that draws air from the clothes drum. It is a further object that the tension of the wrap be self-adjusting and substantially constant notwithstanding geometric irregularities in the clothes drum.

In accordance with the invention, a clothes dryer comprises a clothes drum having an air inlet and a perforated annulus, a cabinet surrounding the drum and defining a region of space between the drum and the cabinet, means for axially rotating the drum, means communicating with the inlet for providing hot air, stationary means surrounding an arcuate portion of the perforated annulus for drawing the hot air into the drum and out of the perforations of the annulus that are instantaneously aligned with the drawing means, and means for preventing air flowing from the drum into the region of space through perforations of the annulus that are not instantaneously aligned with the drawing means wherein the preventing means comprises a flexible wrap supported in sliding engagement by the drum. It is preferable that the wrap comprise an elongated flexible sheet covering that portion of the annulus that is not instantaneously aligned with the drawing means. It is also preferable that the dryer comprises means for rigidly or securely holding a first end of the flexible sheet that is in the direction of rotation of the drum and for resiliently anchoring the opposite or second end of the sheet. The wrap may further comprise means for sealing the flexible sheet to the drum in front of and in back of the perforated annulus. For example, the sealing means may comprise a pair of parallel runners longitudinally adhered to the flexible sheet wherein each runner comprises felt with a low friction coating on the surface contacting the drum. The wrap may also have a plurality of stand-off glides connected to and spaced longitudinally along the flexible sheet to reduce the pressure of the runners on the drum. In a preferred embodiment, the rigid holding means may comprise an angled bracket connecting the first end of the flexible sheet to the drawing means, and the resiliently anchoring means may comprise at least one spring which connects the opposite or second end of the flexible sheet to the opposite side of the drawing means.

It may also be advantageous that the second end of the flexible sheet has a neck portion of reduced width, and that the resiliently anchoring means comprise a bracket having tabs that loosely capture the neck portion wherein the neck portion can move freely in the longitudinal direction within the bracket under bias from the spring. The dryer may also comprise means for sensing the temperature of the hot air drawn from the drum and means responsive to the sensing means for controlling the hot air providing means. Further, a lint filter may preferably be disposed in the drawing means.

With such arrangement, the wrap is supported on or rides on the drum rather than being rigidly affixed to the cabinet. Thus, the wrap is free to flex and follow the contour of the drum which typically would not be true round. Further, by resiliently attaching the wrap on the upstream side of the drum, substantially constant self-adjusting tension is provided on the wrap notwithstanding irregularities in the shape of the drum that it covers. Accordingly, substantially constant and continuous pressure is applied by the wrap on the drum without instantaneously providing excessive pressure that could bind the rotation of the drum. In such manner, the felt runners ride in substantially constant and continuous contact on the drum thereby providing an effective seal that prevents a flow of air from the drum to the interior of the cabinet. Rather, substantially all the air that exits the drum flows into the suction duct either directly or indirectly underneath the wrap. As a result, the accumulation of lint within the cabinet is greatly reduced thereby decreasing the frequency of required maintenance cleaning. Further, the overall efficiency of the dryer is increased because heat losses to the interior of the cabinet are reduced. Further, the temperature of the exhaust air is more reflective or indicative of the drum temperature because the variable and unknown heat losses to the cabinet are greatly restricted; thus, the controller that is responsive to the exhaust air temperature provides a more controlled temperature within the drum.

BRIEF DESCRIPTION OF THE DRAWINGS

The foregoing objects and advantages will be more fully understood by reading the description of the preferred embodiment with reference to the drawings wherein.

DESCRIPTION OF THE PREFERRED EMBODIMENTS

Figure 1:
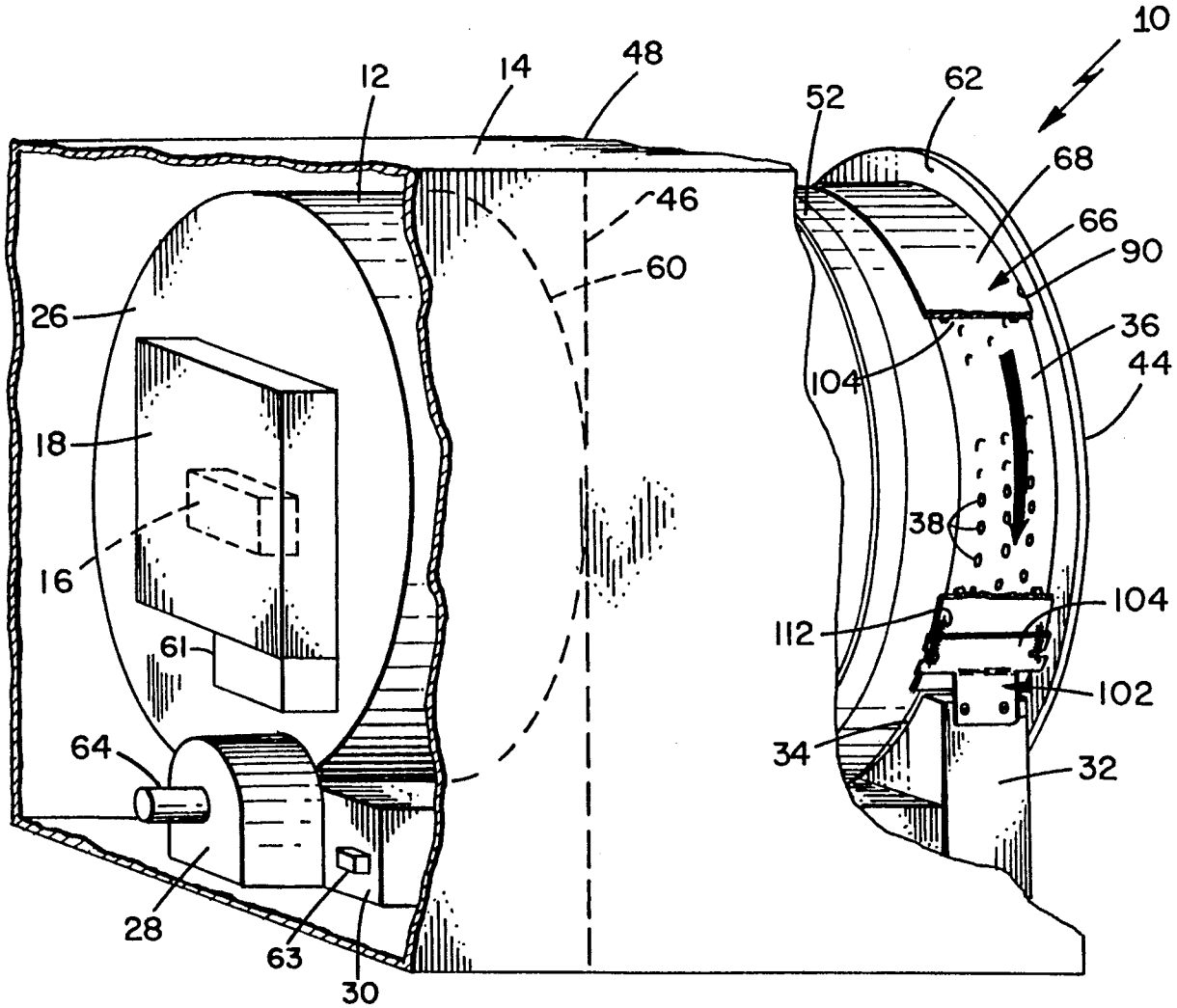
FIG. 1 is a partially broken away view of a gas operated commercial clothes dryer embodying the invention.

Referring to the drawings wherein like numerals refer to like parts throughout the several views, FIG. 1 shows a partially broken away rear perspective view of a commercial gas operated clothes dryer 10 having a tumbler drum 12 or cylinder located within outer cabinet 14 or casing. A burner 16 is located in a burner box 18 that communicates with the interior 20 (FIG. 2) of clothes drum 12 through a rear air inlet 22 including a plurality of apertures 24 in the stationary back wall 26 of drum 12. Hot air from burner box 18 is drawn through drum 12 by exhaust fan 28 or blower positioned adjacent to the rear of drum 12 within cabinet 14. More specifically, exhaust fan 28 is connected to duct 30 or conduit which extends longitudinally forward along the underside of drum 12 and communicates with suction duct 32 or chamber at the front of drum 12.

Figure 2:
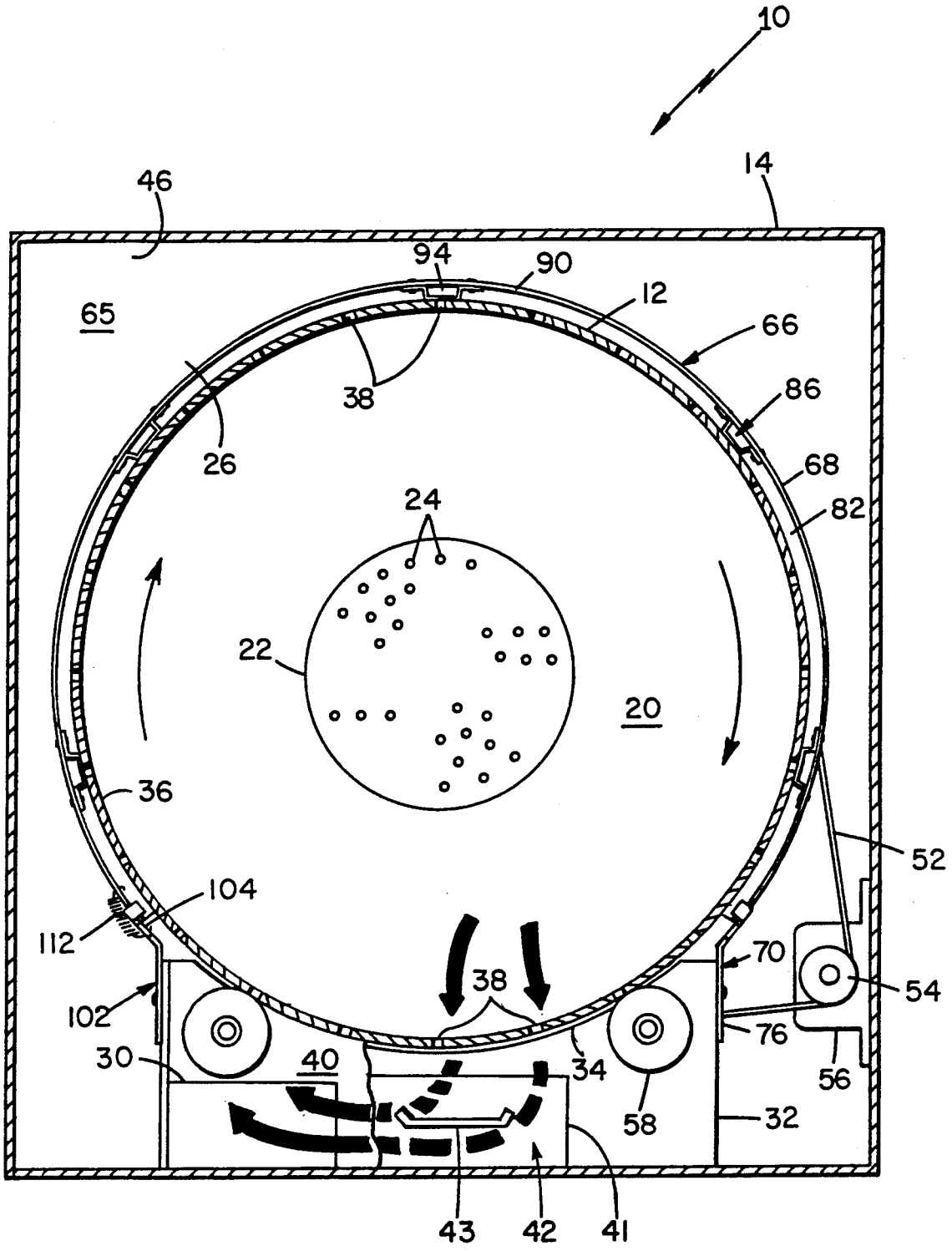
FIG. 2 is a sectioned front view of the clothes dryer of FIG. 1.

Now referring also to FIG. 2, suction duct 32 has an arcuate top opening 34 or mouth that conforms with and is positioned in close spaced relationship with an annulus 36 of perforations 38 at the front of drum 12. Suction duct 32 has a hollow cavity 40 in which is located a suitable lint filter 42 here shown as a drawer 41 that can be pulled out by handle 43 for cleaning, and the cavity 40 communicates with duct 30 such that air drawn from cavity 40 creates a slightly negative pressure along an arcuate portion of the perforated annulus 36 adjacent to opening 34. The front 44 of dryer cabinet 14 is substantially sealed around the door (not shown), and a partition 46 or barrier substantially seals the mid-portion 48 of drum 12 to cabinet 14 such that most of the air being drawn or sucked into opening 34 derives or is drawn from the interior 20 of drum 12 through perforations 38 that are instantaneously aligned with top opening 34. More specifically, drum 12 is axially rotated by suitable apparatus here shown as a belt 52 driven by pulley drive 54 which is connected to motor 56. However, even though drum 12 is being axially rotated to tumble the clothes and suction duct 38 is stationary, there are perforations 36 around the entire circumference of perforated annulus 36 such that in all rotational orientations of drum 12, there are perforations 38 that are closely adjacent to the opening 34 or mouth of suction duct 32 so that air is continuously being drawn from drum 12. As shown in FIG. 2, rollers 58 are here mounted to the front of suction duct 32 and provide support for the front of drum 12 as motor 56 drives belt 52 to rotate drum 12. Partition 46 is generally a panel that has an outer perimeter affixed to dryer cabinet 14 and an interior circular aperture 60 through which drum 12 longitudinally extends. Preferably, a suitable slip gasket (not shown) may be provided to seal drum 12 to partition 46 so as to increase the suction by which suction duct 32 draws air from the interior 20 of drum 12. A flange 62 is attached to the front of drum 12.

The air being sucked or drawn outwardly through instantaneously aligned perforations 38 by suction duct 32 is replaced by air being drawn inwardly through air inlet 22 here shown as a circular pattern of apertures 24 in the back wall 26 which is stationary. In summary, hot air from burner box 18 is drawn through the interior 20 of drum 12 and out perforations 38 into suction duct 32 and back duct 30 to exhaust fan 28. From here, the air can be exhausted through exhaust duct 64 or, alternatively, a small percentage such as, for example, 10% may preferably be recirculated back into drum 12 through back wall 26. In conventional manner, a controller 61 uses a thermal sensor 63 to sense the temperature of exhaust air and, in response thereto, controls the firing of burner 16 to provide a desired temperature in the interior 20 of drum 12.

Figure 3:
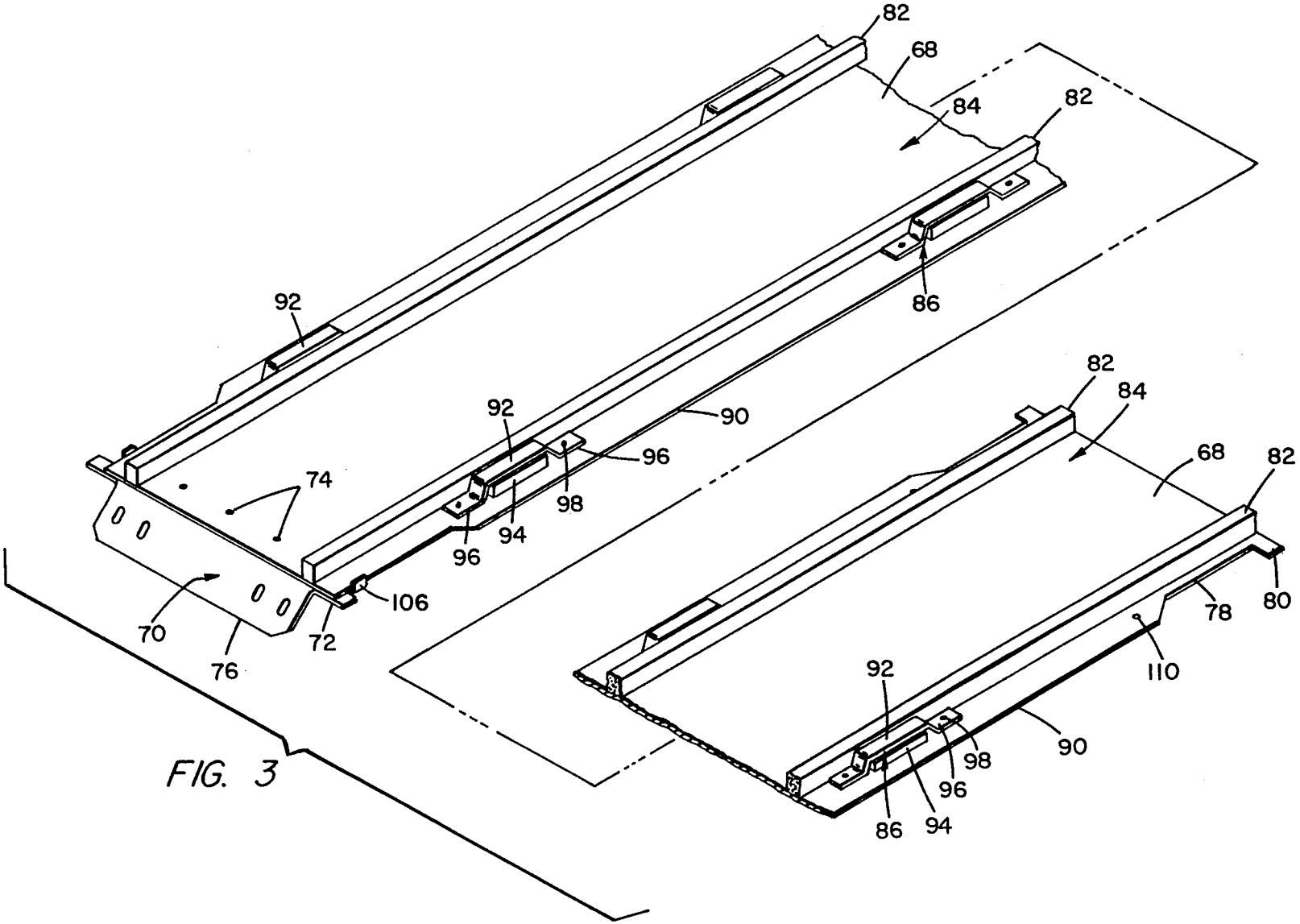
FIG. 3 is a perspective view of the wrap for the perforated annulus of the clothes dryer.

In accordance with the invention, a wrap 66 covers the portion of the perforated annulus 36 which is not instantaneously aligned with suction duct 32 in order to prevent lint laden air from exiting drum 12 through such non-aligned perforations 38 into a region 65 of space inside cabinet 14 outside drum 12. Referring to FIG. 3, wrap includes an elongated flexible sheet 68 or baffle that is preferably made of stainless steel or other non-corroding material such as galvanized steel. Sheet 68 has sufficient length and width to cover, in the manner to be described, that portion of perforated annulus 36 which is non-aligned with suction duct 32. For example, sheet 68 here has a length of approximately 75" and a width of approximately 8.5". A mounting bracket 70 is permanently affixed to a first end of sheet 68. More specifically, mounting bracket 70 has a flat portion 72 permanently affixed to an end of sheet 68 by suitable means such as rivets 74, and a flat leg portion 76 which is angled from portion 72. The opposite or second end of sheet 68 has a narrowed neck 78 with outwardly projecting stops 80 at opposite sides.

Parallel runners 82 are attached to sheet 68 and run the entire longitudinal length thereof forming therebetween a channel 84 having a width greater than perforated annulus 36. Here, runners 82 are felt and have an adhesive on one side to attach to sheet 68 and the opposite side is impregnated or coated with Teflon to provide a low friction, wear resistant surface to contact drum 12. A plurality of glides 86 or stand-offs are attached along the length of sheet 68 between runners 82 and respective edges 90. Here, five glides 86 are positioned along each edge 90. Each glide 86 is made of a wear resistant low friction material such as Rulon which is a mineral filled Teflon material, and includes a flat surface 92 elevated to the approximate height of runners 82 by a felt spacer block 94. The respective ends 96 of each glide are here held in place by rivets 98.

Figure 4:
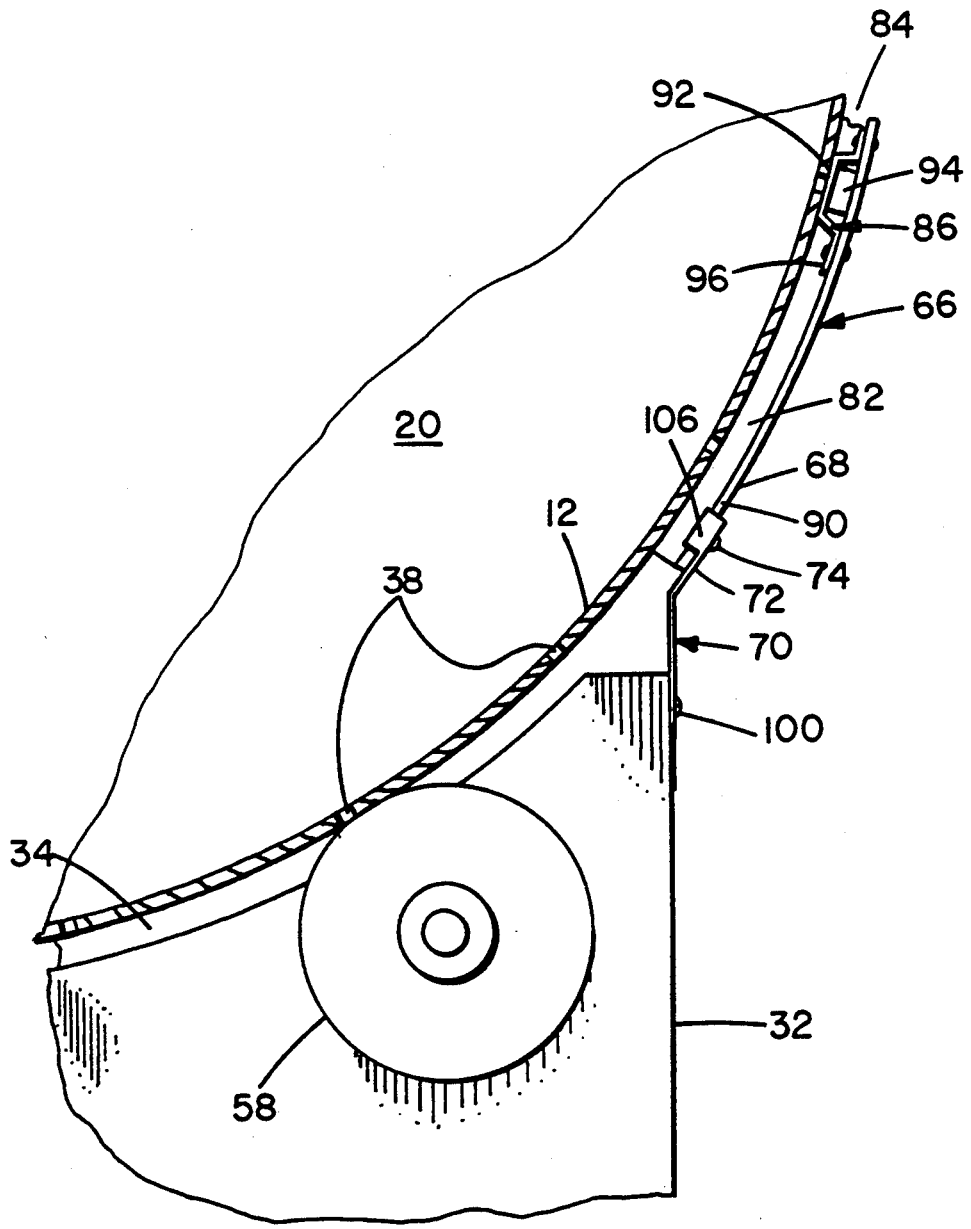
FIG. 4 is an expanded front view of the right side mounting of the wrap.
Figure 5:
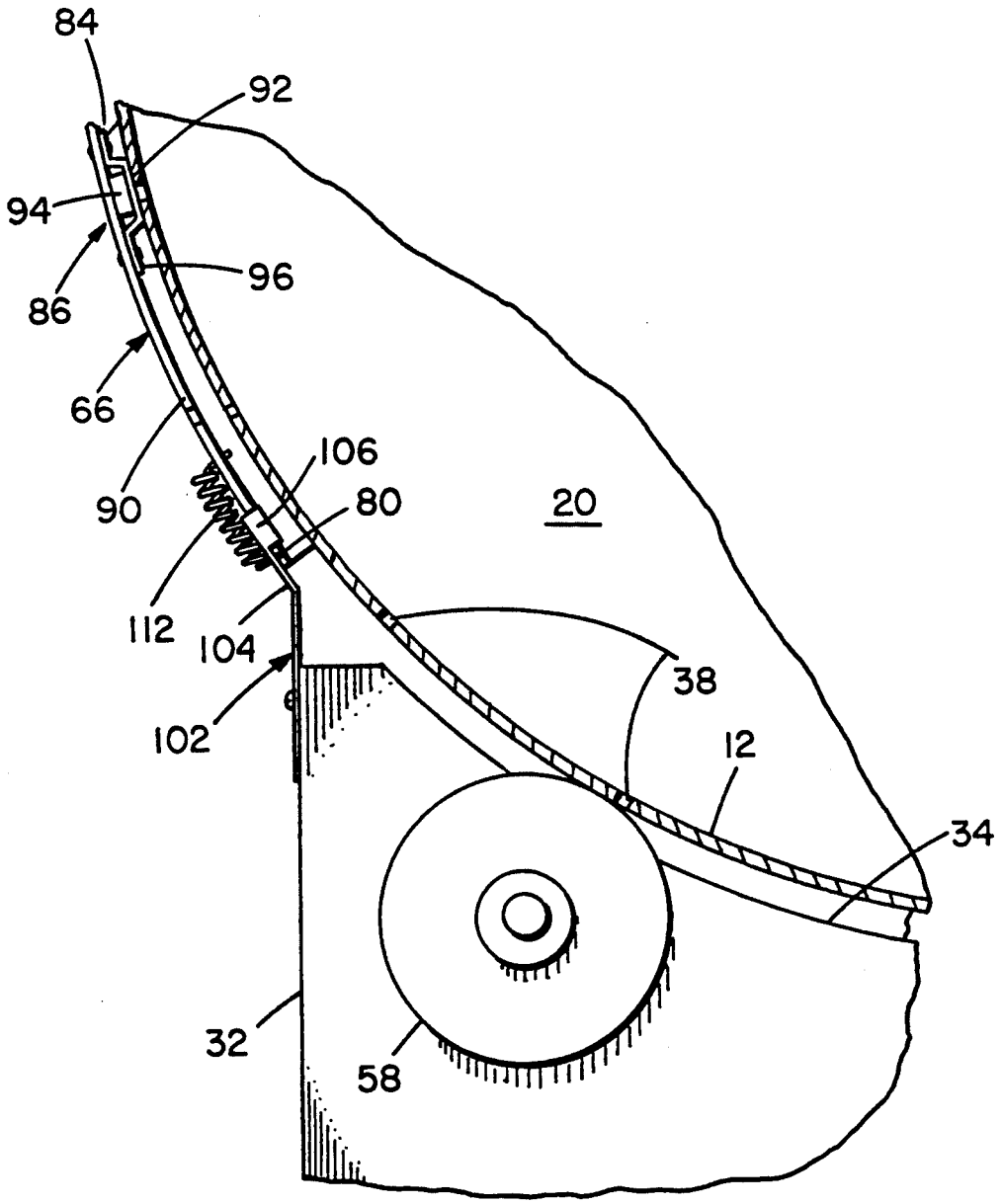
FIG. 5 is an expanded front view of the left side mounting for the wrap.
Figure 6:
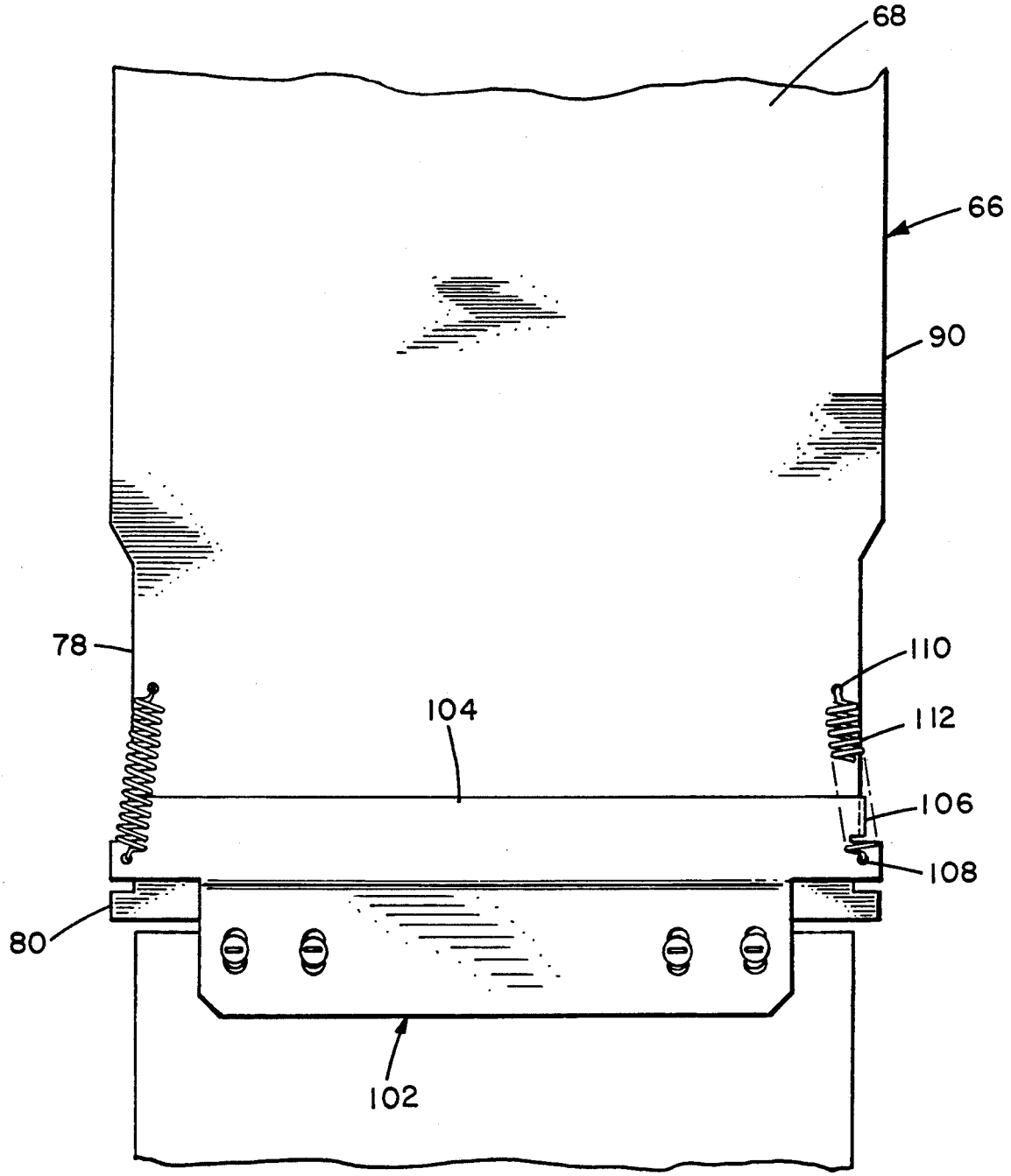
FIG. 6 is a side view of the wrap resiliently mounted to the suction duct.

Still referring to FIG. 2 and also to FIGS. 4 and 5, wrap 66 or sweep sheet is mounted to suction duct 32. More specifically, whether wrap 66 is part of a retrofit kit or included as part of original manufacture, the flat leg portion 76 is mounted by suitable detachable means such as screws 100 to the right side of suction duct 32 such that angled portion 72 is positioned so that felt runners 82 contact drum 12. The length of flexible wrap 66 is positioned up and over drum 12 such that channel 84 covers the top and sides of perforated annulus 36. Specifically, wrap 66 or sweep sheet covers that arcuate portion of perforated annulus 36 that is not instantaneously aligned with suction duct 32. Another mounting bracket 102 which preferably is identical to mounting bracket 70 to minimize parts inventory is connected to the left side of suction duct 32 as shown in FIG. 5. Mounting bracket 102 has an angled flat portion 104 with inwardly directed tabs 106. As mounting bracket 102 is attached to suction duct 32, respective tabs 80 are disposed on opposing sides of neck 78 thereby loosely capturing neck 78 in the guideway therebetween such that the left side of wrap 66 is free to move longitudinally within mounting bracket 102. Stops 80 at the end of wrap 66 are wider than the guideway of tabs 106 thereby preventing the left end of wrap 66 from becoming completely disengaged from bracket 102. As shown in FIG. 5 and also in FIG. 6, angled portion 104 has perimeter holes 108 and sheet 68 has corresponding holes 110, and springs 112 are connected between respective holes 108 and 110 in the manner shown. Thus, springs 112 provide downward tension of a predetermined magnitude on the left side of wrap 66 as viewed from the front.

In summary, wrap 66 is rigidly or securely affixed to suction duct 32 on the right side by mounting bracket 70, and resiliently or spring loaded to suction duct 32 on the left side by springs 112 connected to mounting bracket 102. In operation, drum 12 is here rotated axially in the clockwise direction as viewed from the front, and as shown by arrows in FIG. 2. Thus, even though production tolerances may typically cause drum 12 to be out-of-round such that the circumferential distance around drum 12 between mounting bracket 102 and mounting bracket 70 changes as drum 12 rotates, springs 112 provide substantially constant tension on wrap 66. That is, springs 112 permit wrap 66 to effectively expand and contract to provide self-adjusting constant tension so that runners 82 ride in continuous sliding engagement to maintain substantially uniform and continuous contact with drum 12 notwithstanding irregularities in the dimensions of drum 12. Thus, an effective seal is maintained by runners 82 around a portion of the perforated annulus 36 to prevent air exiting drum into the interior region 65 of cabinet 14 outside of drum 12. Rather, substantially all of the air exiting drum 12 either passes directly into suction duct 32 or passes into channel 84 and is drawn indirectly into suction duct 32. In either case, the exiting air is prevented from flowing into region 65. Such operation substantially prevents lint from collecting within region 65 of cabinet 14 thereby reducing the frequency of required cleaning; rather, substantially all of the lint is drawn through filter 42 where it can be cleaned as part of the normal operating procedure. Also, by preventing the air from flowing into interior region 65, the heating is confined to drum 12 thereby increasing the overall efficiency of dryer 10. Further, because the heat losses to the interior region 65 are minimal and substantially constant, the exhaust air temperature as sensed by temperature sensor 63 corresponds or is indicative of the temperature within drum 12. Thus, the temperature in drum 12 is more closely regulated by controller 61 being responsive to thermal sensor 63 in conventional manner.

The elasticity of springs 112 also enables runners 82 to be tight enough against drum 12 to provide effective seals at the front and back of perforated annulus 36, while still not creating a friction force that puts excessive drag on the rotation of drum 12. That is, the left or upstream side of wrap 66 is permitted to move up and down under substantially constant and self-regulating tension from springs 112 so that the rotation of drum 12 is not bound up.

Further, glides 86 limit the wear on teflon impregnated felt runners 82, and also may reduce the frictional contact area between wrap 66 and drum 12, while still maintaining an effective seal between runners 82 and drum 12.

Another feature of wrap 66 is that it can readily be installed as a retrofit kit, and also can easily be removed for repair. During such installation or removal, it may be preferable to first remove rollers 58 so that the front of drum 12 is slightly lower to provide more clearance at the top and sides. Then, brackets 70 and 102 can readily be installed or removed, depending on the desired operation.

This concludes the description of the preferred embodiments. However, a reading of it by one skilled in the art will bring to mind many alterations and modifications that do not depart from the spirit and scope of the invention. Accordingly, it is intended that the scope of the invention be limited only by the appended claims.

What is claimed is:

1. A clothes dryer comprising:

a clothes drum having an air inlet and a perforated annulus;

a cabinet surrounding said drum and defining a region of space between said drum and said cabinet;

means for axially rotating said drum;

means communicating with said inlet for providing hot air;

stationary means surrounding an arcuate portion of said perforated annulus for drawing said hot air into said drum through said inlet and out perforations of said annulus instantaneously aligned with said stationary drawing means; and means for preventing air flowing from said drum into said region of space through perforations of said annulus not instantaneously aligned with said stationary drawing means, said preventing means comprising a flexible wrap supported in sliding engagement by said drum.

2. The dryer recited in claim 1 wherein said wrap comprises an elongated flexible sheet covering the portion of said annulus not instantaneously aligned with said stationary drawing means.

3. The dryer recited in claim 2 further comprising means for rigidly holding a first end of said flexible sheet and for resiliently anchoring the second end of said flexible sheet.

4. The dryer recited in claim 3 wherein said first end of said flexible sheet is in the direction of rotation of said drum.

5. The clothes dryer recited in claim 2 wherein said wrap comprises means for sealing said flexible sheet to said drum in front of and in back of said perforated annulus.

6. The clothes dryer recited in claim 5 wherein said sealing means comprises a pair of parallel runners longitudinally adhered to said flexible sheet.

7. The dryer recited in claim 6 wherein said runners comprise felt with a low friction coating against said drum.

8. The dryer recited in claim 6 further comprising means comprising a plurality of stand-off glides connected to and spaced longitudinally along said flexible sheet for reducing the pressure of said runners on said drum.

9. The dryer recited in claim 3 wherein said rigid holding means comprises an angled bracket connecting said first end of said flexible sheet to said stationary drawing means.

10. The dryer recited in claim 3 wherein said resiliently anchoring means comprises at least one spring connected to said second end of said flexible sheet.

11. The dryer recited in claim 10 wherein said second end of said flexible sheet has a neck portion and said resiliently anchoring means comprises a bracket having tabs loosely capturing said neck portion wherein said neck portion can move longitudinally within said bracket under bias from said spring.

12. The dryer recited in claim 1 wherein said drawing means comprises a duct having an arcuate mouth spaced adjacent to a portion of said annulus.

13. The dryer recited in claim 12 wherein said drawing means further comprises an exhaust fan sucking air from said duct.

14. The dryer recited in claim 1 further comprising means for sensing the temperature of said air drawn from said drum and means responsive to said sensing means for controlling said hot air providing means.

15. The dryer recited in claim 1 further comprising a lint filter disposed in said drawing means.

16. A clothes dryer comprising:

a horizontally oriented clothes drum having a front annulus with a plurality circumferentially disposed perforations;

a cabinet surrounding said drum and defining a region of space outside said drum within said cabinet;

means for rotating said drum;

a stationary back wall positioned adjacent said drum and having an air inlet to said drum;

a burner box communicating with said air inlet on said stationary back wall;

a stationary duct having an arcuate top mouth proximately spaced to an arcuate bottom portion of said annulus;

an exhaust blower coupled to said duct for drawing air from said burner box through said drum and out instantaneous ones of said perforations aligned with said duct; and an elongated flexible wrap covering the portion of said annulus not instantaneously aligned with said duct to prevent air exiting said drum into said region of space within said cabinet through perforations not instantaneously aligned with said duct, said wrap passing over the top of said drum and being supported on said drum.

17. The dryer recited in claim 16 further comprising a mounting bracket rigidly holding the end of said wrap in the direction of rotation of said drum.

18. The dryer recited in claim 16 further comprising a spring resiliently anchoring the end of said wrap opposite the direction of rotation of said drum.

19. The dryer recited in claim 16 further comprising a bracket mounted to said duct and holding said spring.

20. The dryer recited in claim 16 wherein said wrap comprises a pair of parallel felt runners affixed to said flexible sheet and respectively disposed in front of and behind said annulus to seal said flexible sheet to said drum.

21. The dryer recited in claim 20 further comprising a plurality of glide members spaced along said flexible sheet to reduce the wear on said runners.

22. The dryer recited in claim 16 further comprising a thermal sensor positioned to sense the temperature of said air being drawn into said duct, said dryer further comprising a burner controller responsive to said thermal sensor.

23. The dryer recited in claim 16 further comprising a lint filter positioned in said stationary duct.

24. In a clothes dryer having a drum with a perforated front annulus and a suction duct surrounding an arcuate portion thereof for drawing hot air from a burner communicating with an air inlet of said drum through said drum while said drum is being rotated, the method of attaching a wrap around the portion of said annulus which is not instantaneously aligned with said duct, comprising the steps of:

positioning said wrap over said drum so that said wrap is supported on said drum;

rigidly affixing the end of said wrap in the direction of rotation of said drum to said duct; and resiliently affixing the opposite end of said wrap to said duct.

* * * * *